United States Patent [19]

Hazlewood

[11] Patent Number: 4,991,855

[45] Date of Patent: Feb. 12, 1991

[54] APPARATUS FOR PLAYING A GAME

[76] Inventor: Richard Hazlewood, 7 Firs Close, Hitchin, Hertfordshire, England

[21] Appl. No.: 227,910

[22] PCT Filed: Jan. 30, 1987

[86] PCT No.: PCT/GB87/00065

§ 371 Date: Jul. 29, 1988

§ 102(e) Date: Jul. 29, 1988

[87] PCT Pub. No.: WO87/04636

PCT Pub. Date: Aug. 13, 1987

[30] Foreign Application Priority Data

Jan. 31, 1986 [GB] United Kingdom ..... 8602488
Mar. 27, 1986 [GB] United Kingdom ..... 8607649

[51] Int. Cl.[5] ..... A63F 3/02
[52] U.S. Cl. ..... 273/258; 273/261
[58] Field of Search ..... 273/258, 260, 261

[56] References Cited

U.S. PATENT DOCUMENTS

| | | | |
|---|---|---|---|
| 104,379 | 6/1870 | Vander Weyde | 273/261 |
| 1,319,399 | 10/1919 | Lanpher | 273/258 |
| 1,552,354 | 9/1925 | Stanage | 273/261 |
| 1,623,881 | 4/1927 | Mayer | 273/261 X |
| 1,674,791 | 6/1928 | Patocka | 273/273 |
| 3,724,856 | 4/1973 | Welch | 273/261 |
| 3,730,527 | 5/1973 | Nelson | 273/258 |

FOREIGN PATENT DOCUMENTS

| | | |
|---|---|---|
| 2648345 | 4/1978 | Fed. Rep. of Germany . |
| 882160 | 2/1943 | France . |

*Primary Examiner*—William H. Grieb
*Attorney, Agent, or Firm*—Nixon & Vanderhye

[57] ABSTRACT

Apparatus for playing a game comprises a generally rhomboidal playing area and first and second sets of playing pieces associated with a pair of opposing players. The playing pieces of the first set are of a first color and the playing pieces of the second set are of a second color. The playing area has an 8×8 array of playing positions. The playing positions at a pair of opposed apices of the playing area are designated master playing positions, each master playing position having the same color as the playing pieces of a respective one of the teams. Each set of playing pieces has a master playing piece and at least first, second and third groups of playing pieces. Each first group has at least two identical playing pieces which are movable over the playing area in a first predetermined manner. Each second group has at least three identical playing pieces which are movable over the playing area in a second predetermined manner. Each third group has at least four identical playing pieces which are movable over the playing area in a third predetermined manner. Each master playing piece is movable over the playing area in a further predetermined manner. The object of the game is for each player to move his/her master playing piece from the associated master playing position to the other master playing position.

7 Claims, 3 Drawing Sheets

APPARATUS FOR PLAYING A GAME

This invention relates to apparatus for playing a game.

The present invention provides apparatus for playing a game, the apparatus comprising a generally rhomboidal playing area and first and second sets of playing pieces, the sets being associated, in use, with a pair of opposing players, the playing pieces of the first set having a first identifiable characteristic, and the playing pieces of the second set having a second identifiable characteristic distinguishable from the first identifiable characteristic, the playing area having an n×n array of playing positions, where n is an integer greater than 5, the playing positions at a pair of opposed apices of the playing area being designated master playing positions, each master playing position having an identifiable characteristic corresponding to that of a respective set of playing pieces, and each set of playing pieces having a master playing piece and at least first, second and third groups of playing pieces, each first group having at least two identical playing pieces which are movable over the playing area in a first predetermined manner, each second group having at least three identical playing pieces which are movable over the playing area in a second predetermined manner, and each third group having at least four identical playing pieces which are movable over the playing area in a third predetermined manner, each master playing piece being movable over the playing area in a further predetermined manner, the object of the for each player to move his/her master playing the associated master playing position to other master playing position.

In a preferred embodiment, the playing area has an 8×8 array of playing and each set of playing pieces includes a fourth group of playing pieces, each fourth group having at five identical playing pieces which are movable over playing area in a fourth predetermined manner. Preferably, each first group has two playing pieces, each second group has three playing pieces, each third four playing pieces, and each fourth group has playing pieces. Alternatively, each third may have five playing pieces, and each fourth group have seven playing pieces.

Advantageously, the first and second identifiable characteristics are colours, for example silver and gold.

In a preferred embodiment, each master playing piece is movable from a given position to an adjacent playing position in any of the horizontal, vertical and diagonal directions. In this connection, it should be noted that the vertical direction is the direction parallel to the straight line joining the apices of the playing area occupied by the master playing positions, the horizontal direction is the direction parallel to the straight line joining the other two apices of the playing area, and the diagonal directions are the directions parallel to the sides defining the rhomboidal playing area.

Preferably, each playing piece of each first group is movable from a given playing position in either the vertical direction or the horizontal direction to any playing position in the chosen direction of movement, provided it does not jump over any other playing piece; each playing piece of each second group is movable from a given playing position in any diagonal direction to any playing position in the chosen direction of movement, provided it does not jump over any other playing piece; each playing piece of each third group is movable from a given playing position either vertically to an adjacent playing position or horizontally to an adjacent playing position and then in any diagonal direction to an adjacent playing position; and each playing piece of each fourth group is movable from a given playing position to an adjacent playing position either horizontally or in any diagonal direction.

Any playing piece may "take" an opposing playing piece by landing on the playing position occupied by said opposing playing piece.

A game apparatus constructed in accordance with the invention will now be described, by way of example, with reference to the accompanying drawings, in which.

Figure 1:
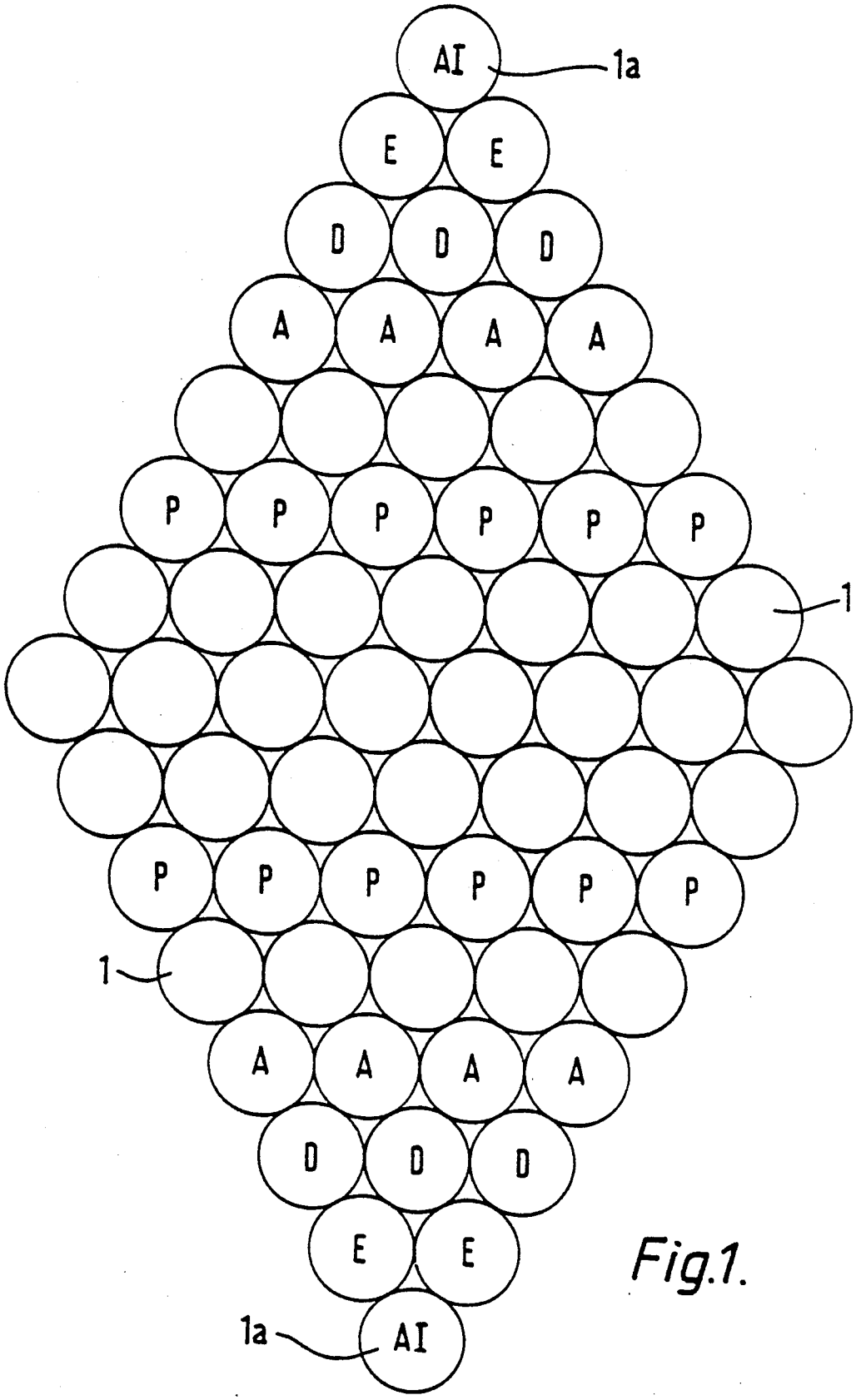
FIG. 1 is a schematic plan view of the playing area of the apparatus, and shows schematically the playing pieces of the apparatus at the start of the game.

Referring to the drawings, FIG. 1 shows a playing area constituted by a regular 8×8 array of circular playing positions (spaces) 1. The spaces 1 are disposed so as to define a diamond-shaped (rhomboidal) playing area. The spaces 1*a* at the "acute end" apices of the playing area are defined as data bases or memories (master spaces). These spaces 1*a* are of different colours to each other and to the rest of the playing area. One space 1*a* is gold, the other being silver. The rows of spaces defining the rest of the playing are alternately red and black, the spaces of each row adjacent to each of the data bases 1*a* being red.

Figure 2:
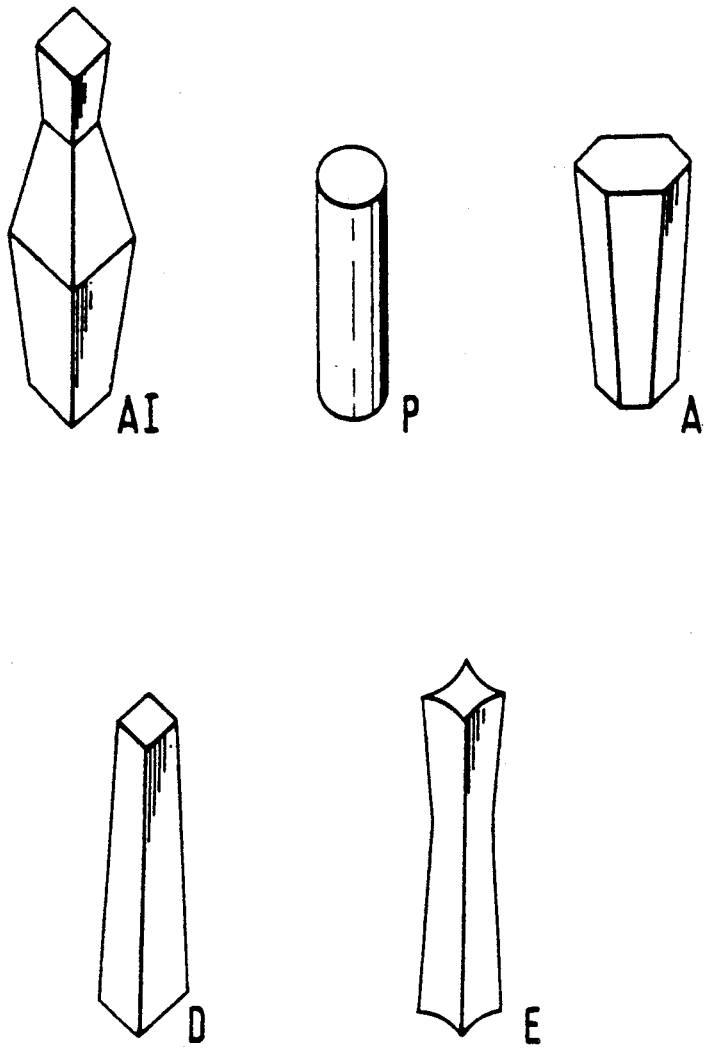
FIG. 2 shows the playing pieces of the apparatus.

The game is for two players, each of which controls a team of playing pieces. Each team of playing pieces includes playing pieces of five different types. The playing pieces of one team are coloured gold, and the playing pieces of the other team are coloured silver. Each team consists of an artificial intelligence AI, two systems executives E, three systems designers D, four systems analysts A, and six systems programmers P. FIG. 2 shows the design of each of these playing pieces.

Figure 3:
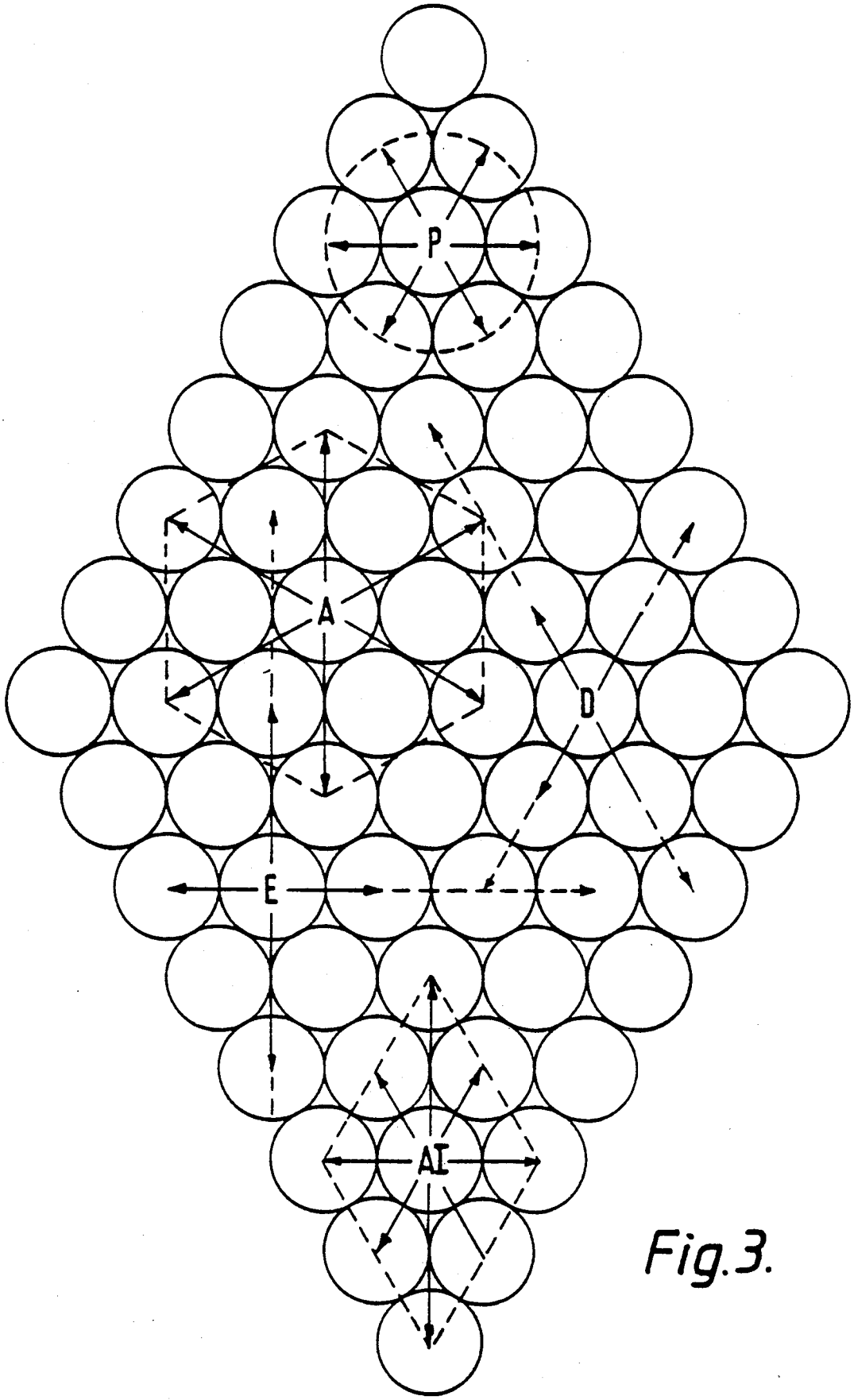
FIG. 3 is a schematic plan view showing how the playing pieces move.

The movement of each of the playing pieces will now be described with reference to FIG. 3, the directions of movement being defined as the vertical, horizontal and diagonal directions. In this connection, the vertical direction is taken to be the direction parallel to the straight line joining the spaces 1*a*, the horizontal direction is taken to be the direction parallel to the straight line joining the other two apices of the playing area, and the diagonal directions are taken to be the directions parallel to the sides of the rhomboidal playing area. According to these definitions, the rows of spaces 1 extend in the horizontal direction.

Each systems programmer P may move one space in any diagonal or horizontal direction. Each systems analyst A may move one space vertically or may move one space horizontally and then one space diagonally (that is to say a systems analst A can move to any one of the six spaces which define a hexagon surrounding the six spaces to which a systems programmer p could move). A systems analyst A can move to a legitimate destination space, even if an intermediate space is occupied by another playing piece. Each systems designer D may move in any diagonal direction through any number of spaces desired, provided it does not jump over any other playing piece. Each systems executive E may move either horizontally or vertically through as many spaces as desired, provided it does not jump over any other playing piece. Consequently, a systems executive E can move only on red spaces. Each artificial intelligence AI may move to the adjacent space in any vertical, horizontal or diagonal direction.

Any playing piece may capture or take any opposing playing piece by landing on the space occupied by that opposing playing piece. Captured playing pieces must be removed from the playing area, and cannot be returned thereto.

At the beginning of the game, the playing pieces are positioned as shown in FIG. 1, with each artificial intelligence AI on the data base 1*a* of the same colour. The aim of the game is to move one's artificial intelligence Ai from its own data base 1*a* to occupy the data base 1*a* of the opponent. If a player manages to do this, he/she wins the game. However, a player that loses his/her artificial intelligence AI does not lose the game, as the game can still be drawn by that player removing the artificial intelligence AI of his/her opponent.

In a simplified version of the game, each team may include only five systems programmers P. At the start of the game, the systems programmers P will then be placed in the row next to that occupied by the systems analysts A. In a still simpler form of the game (intended primarily for beginners and children), the systems programmers P may be dispensed with altogether, and the game played on a playing area having a regular array of 7×7 spaces. It would also be possible to modify the game to make it more difficult. For example, one version of the game has a rhomboidal playing area constituted by a regular array of 9×9 circular spaces. In this case, each team would have five systems analysts A, and seven systems programmers P. At the start of the game, the systems analysts A of each team are positioned on the five spaces of the row which is two rows away from that occupied by the systems designers D of that team; and the seven systems programmers p of each team are positioned on the seven spaces of the row which is two rows away from that occupied by the systems analysts A of that team. It would also be possible, with suitable software, to provide a "computer" game version of the game, so that a player could play against a computer.

I claim:

1. Apparatus for playing a game, the apparatus comprising a generally rhomboidal playing area and first and second sets of playing pieces, the sets being associated, in use, with a pair of opposing players, the playing pieces of the first set having a first identifiable characteristic, and the playing pieces of the second set having a second identifiable characteristic distinguishable from the first identifiable characteristic, the playing area having an n×n array of playing positions, where n is an integer greater than 5, the playing positions at a pair of opposed apices of the playing area being designated target playing positions, each target playing position having an identifiable characteristic corresponding to that of a respective set of playing pieces, and each set of playing pieces having a master playing piece and at least first, second and third groups of playing pieces, each first group having at least two identical playing pieces each of which is movable over the playing area from a given playing position in either the vertical direction or the horizontal direction to any playing position in the chosen direction of movement, provided it does not jump over any other playing piece, each second group having at least three identical playing pieces each of which is movable over the playing area from a given playing position in any diagonal direction to any playing position in the chosen direction of movement, provided it does not jump over any other playing piece, and each third group having at least four identical playing pieces each of which is movable over the playing area from a given playing position either vertically to an adjacent playing position or horizontally to an adjacent playing position and then in any diagonal direction to an adjacent playing position, each master playing piece being movable over the playing area from a given playing position to an adjacent playing position in any of the horizontal, vertical and diagonal directions.

2. Apparatus as claimed in claim 1, wherein the playing area has an 8×8 array of playing positions, and each set of playing pieces includes a fourth group of playing pieces, each fourth group having at least five identical playing pieces each of which is movable over the playing area from a given playing position to an adjacent playing position either horizontally or in any diagonal direction.

3. Apparatus as claimed in claim 2, wherein each first group has two playing pieces, and each second group has three playing pieces.

4. Apparatus as claimed in claim 3, wherein each third group has four playing pieces, and each fourth group has six playing pieces.

5. Apparatus as claimed in claim 3, wherein each third group has five playing pieces, and each fourth group has seven playing pieces.

6. Apparatus as claimed in claim 2, wherein each playing piece of each fourth group is movable from a given playing position to an adjacent playing position either horizontally or in any diagonal direction.

7. Apparatus as claimed in claim 1 wherein the first and second identifiable characteristics are different colours.

* * * * *